US005533263A

United States Patent [19]

Gilder

[11] Patent Number: 5,533,263

[45] Date of Patent: Jul. 9, 1996

[54] RAZORS

[75] Inventor: Bernard Gilder, Berkshire, United Kingdom

[73] Assignee: The Gillette Company, Boston, Mass.

[21] Appl. No.: 244,039

[22] PCT Filed: Nov. 25, 1992

[86] PCT No.: PCT/GB92/02169

§ 371 Date: May 20, 1994

§ 102(e) Date: May 20, 1994

[87] PCT Pub. No.: WO93/10947

PCT Pub. Date: Jun. 10, 1993

[30] Foreign Application Priority Data

Nov. 27, 1991 [GB] United Kingdom ..... 9125261
Nov. 3, 1992 [GB] United Kingdom ..... 9222984

[51] Int. Cl.[6] ..... B26B 21/52

[52] U.S. Cl. ..... 30/87; 30/85

[58] Field of Search ..... 30/47, 50, 57, 30/85, 87, 89

[56] References Cited

U.S. PATENT DOCUMENTS

| | | | |
|---|---|---|---|
| 939,935 | 11/1909 | Wilcox | 30/50 |
| 1,234,834 | 7/1917 | Warren | 30/47 |
| 1,396,645 | 11/1921 | Madden | 30/47 |
| 2,386,536 | 10/1945 | Bensel | 30/47 |
| 3,593,416 | 7/1971 | Edson | 30/50 |
| 3,975,820 | 8/1976 | Torance | 30/47 |
| 4,026,016 | 5/1977 | Nissen | 30/47 |
| 4,083,104 | 4/1978 | Nissen et al. | 30/47 |
| 4,094,063 | 6/1978 | Trotta | 30/47 |
| 4,198,746 | 4/1980 | Trotta | 30/89 X |
| 4,227,302 | 10/1980 | Torrance | 30/47 |
| 4,253,235 | 3/1981 | Jacobson | 30/47 |
| 4,253,236 | 3/1981 | Jacobson | 30/47 |
| 4,253,237 | 3/1981 | Jacobson | 30/89 |
| 4,258,471 | 3/1981 | Jacobson | 30/89 |
| 4,275,498 | 6/1981 | Ciaffone | 30/47 |
| 4,308,663 | 1/1982 | Ciaffone | 30/89 |
| 4,392,303 | 7/1983 | Ciaffone | 30/85 |
| 4,459,744 | 7/1984 | Esnard | 30/49 |
| 4,475,286 | 10/1984 | Saito | 30/87 |
| 4,488,357 | 12/1984 | Jacobson | 30/57 |
| 4,492,025 | 1/1985 | Jacobson | 30/87 |
| 4,514,904 | 5/1985 | Bond | 30/87 |
| 4,599,793 | 7/1986 | Iten | 30/89 X |
| 4,715,120 | 12/1987 | McGready | 30/57 |
| 4,739,553 | 4/1988 | Lazarchik | 30/47 |
| 4,785,534 | 11/1988 | Lazarchik | 30/50 |
| 4,797,998 | 1/1989 | Motta | 30/87 |
| 4,970,784 | 11/1990 | Althaus et al. | 30/89 |
| 5,199,173 | 4/1993 | Hegemann et al. | 30/49 |
| 5,333,383 | 8/1994 | Ferraro | 30/87 |
| 5,347,717 | 9/1994 | Ts'ai | 30/89 |

FOREIGN PATENT DOCUMENTS

| | | |
|---|---|---|
| 0020816A1 | 1/1981 | European Pat. Off. . |
| 0357821A1 | 3/1990 | European Pat. Off. . |
| 0357821B1 | 3/1990 | European Pat. Off. . |
| 7603885 | 10/1977 | Netherlands . |

*Primary Examiner*—Hwei-Siu Payer
*Attorney, Agent, or Firm*—Fish & Richardson

[57] ABSTRACT

A safety razor comprises a blade unit mounted on a handle for pivotal movement in one direction from a rest position, the pivot axis being arranged to underlie the guard surface. In the rest position, the entire handle is disposed forwardly of a plane containing the trailing edge of the guard surface. The handle is pivoted to the blade unit by connection pieces having stub axles engaged in apertures in the blade unit, and edges bearing against cam faces on the blade unit to urge the blade unit to the rest position, the connection pieces being carried by wings either acted upon by springs or having a resilient form.

6 Claims, 3 Drawing Sheets

RAZORS

This invention relates to razors, and is particularly concerned with a safety razor of the kind comprising a handle and a blade unit mounted on the handle with the capability to pivot during shaving to adjust itself to the contours of the surface being shaved, there being spring means acting between the handle and blade unit to urge the blade unit to a "rest" position.

In known razors of this kind the pivot axis, as seen in a direction perpendicular to a plane containing the guard surface and the edge of the blade adjacent to the guard, is located between the guard and the cap of the blade unit, i.e. generally behind the blade or blades, and the blade unit is arranged to pivot in both directions from its rest position. With such arrangements the handle tends to impede flow of water through the blade unit for rinsing away soap and shaving debris.

In accordance with the present invention there is provided a safety razor comprising a blade unit including a guard and at least one blade, and a handle mounting the blade unit for pivotal movement in one direction only from a rest position, characterised in that the pivot axis underlies the guard surface as seen in a direction normal to a plane containing the guard surface and the edge of the adjacent blade.

With the pivot axis located to underly the guard surface, the force of the blades against the skin during shaving will be mainly influenced by the spring means which opposes pivotal displacement of the blade unit from the rest position and applies a restoring force to return the blade unit to the rest position when it has been deflected from that position. As a consequence if the user wishes to apply more force to the guard, for example to stretch the skin, this can be done without increasing the force of the blades on the skin. This could not be achieved by prior art razors.

In addition, the handle can be arranged so as not to obstruct flow of rinsing water through the blade unit and in accordance with a preferred feature, with the blade unit in the rest position, the handle is located entirely forwardly of a plane containing the edge of the blade adjacent the guard and perpendicular to said plane containing said edge and the guard surface. (For convenience the latter plane is hereinafter referred to as the "top plane" of the blade unit.) Ideally the handle is located entirely forwardly of a plane containing the trailing edge of the guard surface and perpendicular to the top plane of the blade unit.

The blade unit may be pivotally movable through an angle in the range of 35° to 50° preferably 40° to 45°, from the rest position to a limit position, and both these end positions are conveniently defined by stops provided on the blade unit for abutment by the handle connection pieces.

In a specific embodiment of the invention, when the blade unit is in the rest position, the top plane thereof is at 20°–30° to the longitudinal axis of the handle, i.e. the axis of that part of the handle intended to be held in the hand. Furthermore, the pivot axis is 1.0–2.0 mm, preferably 1.25–1.75 mm, from the leading blade edge and 0.50–1.00 mm below the guard surface.

In accordance with a second aspect the invention provides a razor comprising a blade unit, and a handle mounting the blade for pivotal movement, from a rest position, the handle being connected to the blade unit by a pair of opposed connection pieces engaging the blade unit at the respective ends thereof, characterized in that the connecting pieces are urged resiliently into abutment with cam faces on the blade unit whereby to oppose displacement of the blade unit from the rest position and to apply a restoring force for returning the blade unit to the rest position after having been pivoted away therefrom.

Conveniently the handle has a pair of wings with tips forming the connection pieces and biased apart by the wings. In one embodiment, the handle is intended to be used with blade units in the form of replaceable cartridges, and the wings are hinged elements acted upon by spring means incorporated in the handle structure. In another embodiment the wings are integral with the handle and are themselves resilient. In both cases the wing tips comprise pivot elements, particularly pins or stub axles, which cooperate with complementary means on the blade unit to define the pivotal connection between the handle and blade unit. Adjacent their pivot elements, the wing tips have edge surfaces which abut the cam faces. It will be appreciated that by virtue of the wing tips a simple pivot assembly with return spring is obtained. Furthermore, the blade unit can be made easily detachable by squeezing the wings together.

A full understanding of the invention will be gained from the following detailed description of some specific embodiments which are given by way of non-limiting example only, reference being made to the accompanying drawings in which.

Figure 1:
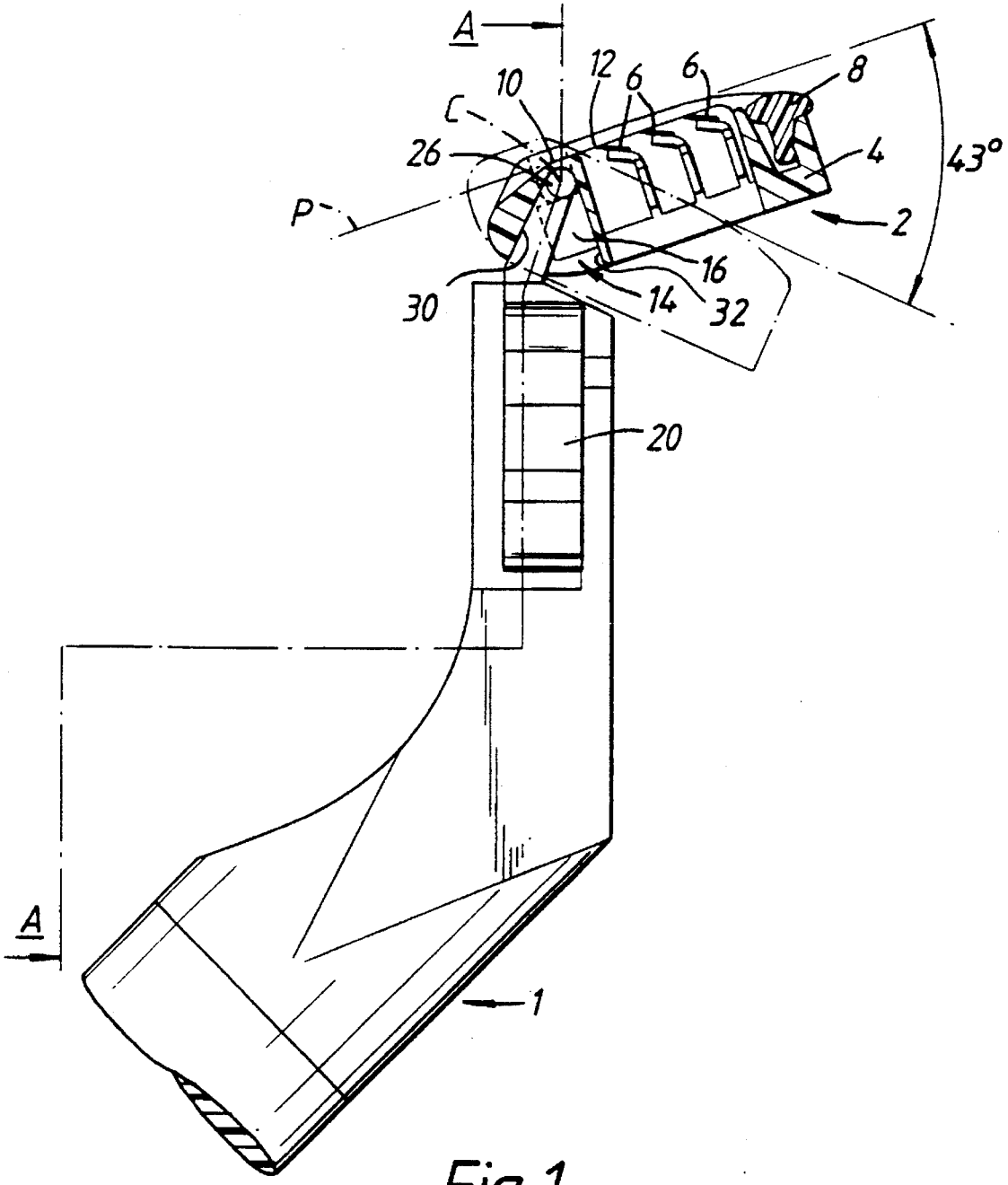
FIG. 1 is a side view of a razor head portion, the blade unit thereof being shown in transverse cross section.
Figure 2:
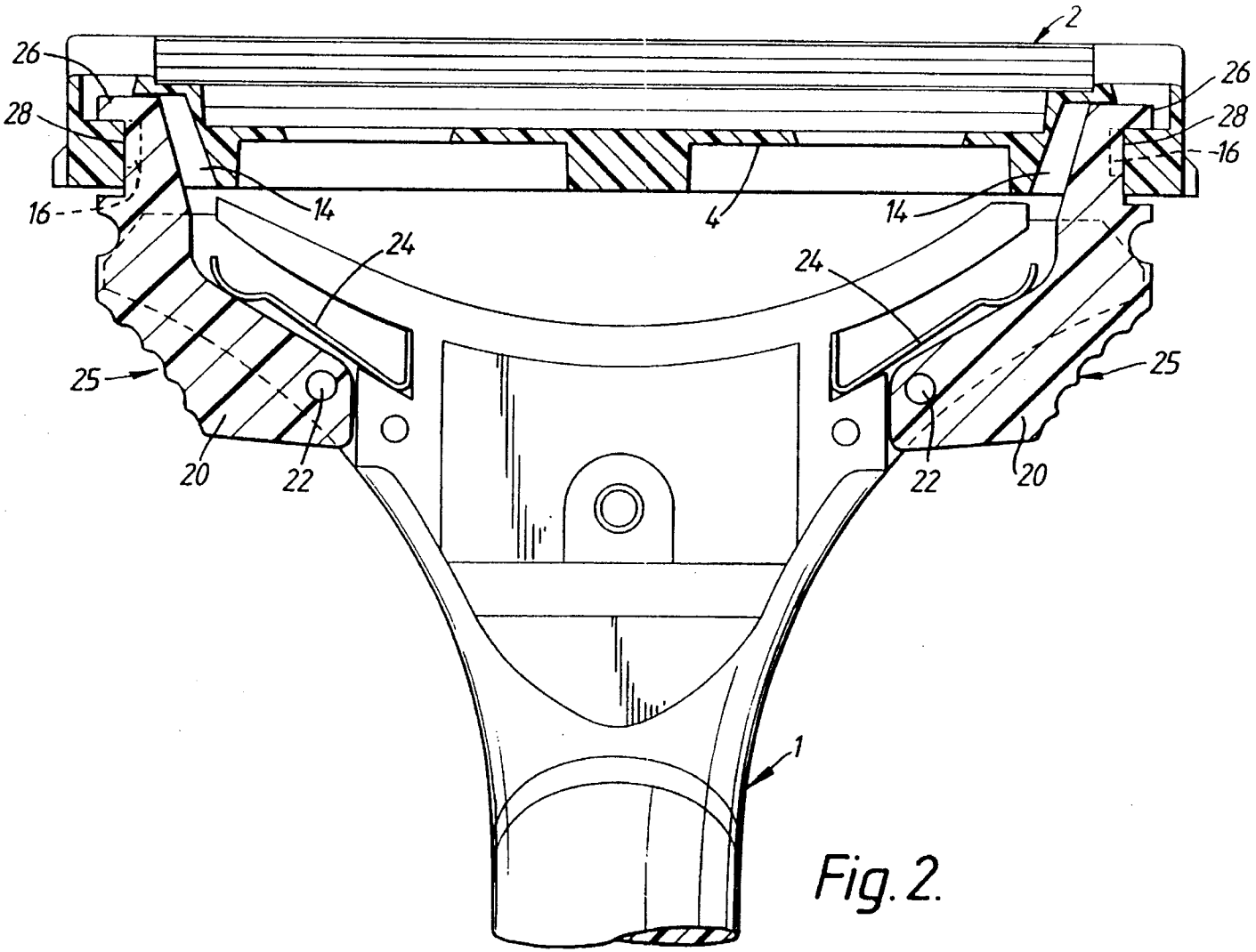
FIG. 2 is a section taken along the line A—A in FIG. 1.
Figure 3:
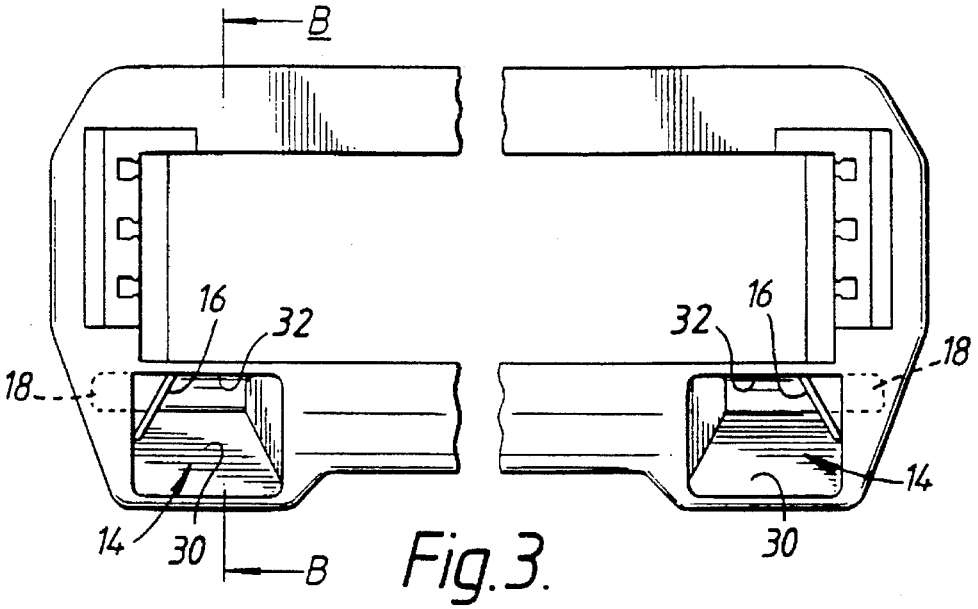
FIG. 3 is a partial view of the underside of the blade unit.
Figure 4:
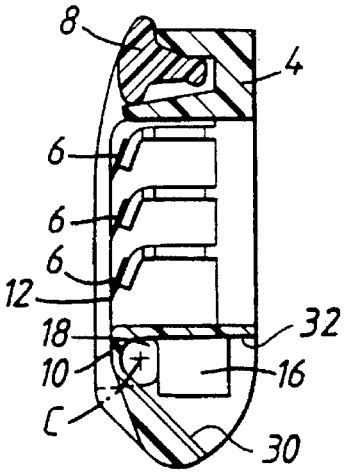
FIG. 4 is a section taken along the line B—B of FIG. 3.

The safety razor illustrated in FIGS. 1 and 2 has a handle 1 and a blade unit or cartridge 2, the razor being of the type in which the cartridge is intended to be discarded when the blades have become dulled and to be replaced on the handle by a new cartridge with sharp blades. The blade cartridge includes a housing or frame 4 in which are received at least one blade, there being three blades 6 in the specific example shown, and a lubricating strip 8 which forms the cap of the assembly. The frame includes an integral guard member defining a guard surface 10 extending along the cartridge parallel to the leading blade edge 12. Of course, the guard surface could be defined instead by a separate member carried by the cartridge frame. At the opposite ends of the frame and adjacent the front edge thereof there are defined respective sockets 14 for reception of handle connection pieces. Each socket includes a longitudinally inwardly directed cam face 16. As best seen from FIG. 3, the cam faces are inclined to converge towards each other in the direction towards the rear of the cartridge. Immediately above each cam face is an aperture 18 directed longitudinally outwardly from the socket and having a centre which defines the pivot axis C of the cartridge when mounted on the handle.

The razor handle includes a main part, only partially shown, intended to be grasped in the hand, and a neck in the form of a yoke with opposed arms having grooves or slots in which respective wings 20 are mounted by pivots 22. The free ends or tips of the wings are biased apart by leaf springs 24 incorporated in the handle and acting on the respective wings. As shown the wings include finger grip portions 25 intermediate their ends for squeezing the wings together against the action of the springs. The wing tips engage in the respective sockets 14 of the cartridge and have stub axles 26 which engage in the apertures 18 to form the pivot between the handle and blade unit and hence define the pivot axis C.

The springs 24 acting on the wings urge the stub axles 26 into correct engagement in the apertures 18, but also press abutment edges 28 on the wing tips into contact with the cam faces 16. The sockets 14 each having front surface 30 and rear surface 32 which serve as stops for the wing tips and thereby limit the pivotal movement of the cartridge with respect to the handle.

Due to the inclination of the cam faces 16, the wing tips bias the cartridge to a rest position, shown in FIG. 1, in which the wing tips engage the front stop surfaces of the sockets 14. When the cartridge is pivotally displaced away from this position, e.g. during shaving, the cam faces 16 cam the wing tips inwardly towards each other and a gradually increasing restoring force tending to return the cartridge to the rest position is generated.

As may be seen clearly from FIG. 1, the axis C about which the cartridge pivots with respect to the handle underlies the guard surface 10, as seen in a direction perpendicular to the top plane P of the cartridge containing the guard surface and the leading blade edge 12. The displacement between the axis C and the leading blade edge, measured in the plane P, is substantially equal to 1.5 mm and the depth of the axis C below the surface 10 is substantially equal to 0.70 mm. In the rest position, the top plane P is at an angle substantially equal to 25° relative to the longitudinal axis of the main handle part. The rear faces of the sockets 14 limit the maximum pivotal displacement of the cartridge to an angle of substantially 43° as indicated in broken line in FIG. 1. When the cartridge is in the rest position, the rear of the cartridge is unencumbered by the handle, at least in the region of the blades, i.e. between the guard and cap. In particular, the handle is located entirely forwardly of a plane containing the trailing edge of the guard surface 10 and perpendicular to the top plane P.

To detach the cartridge, the handle wings 20 are squeezed together, e.g. between the thumb and forefinger. The stub axles 26 are retracted from the apertures 18 and the wing tip can then be withdrawn from the sockets 14. A fresh cartridge can then be mounted on the handle by the reverse procedure.

Figure 5:
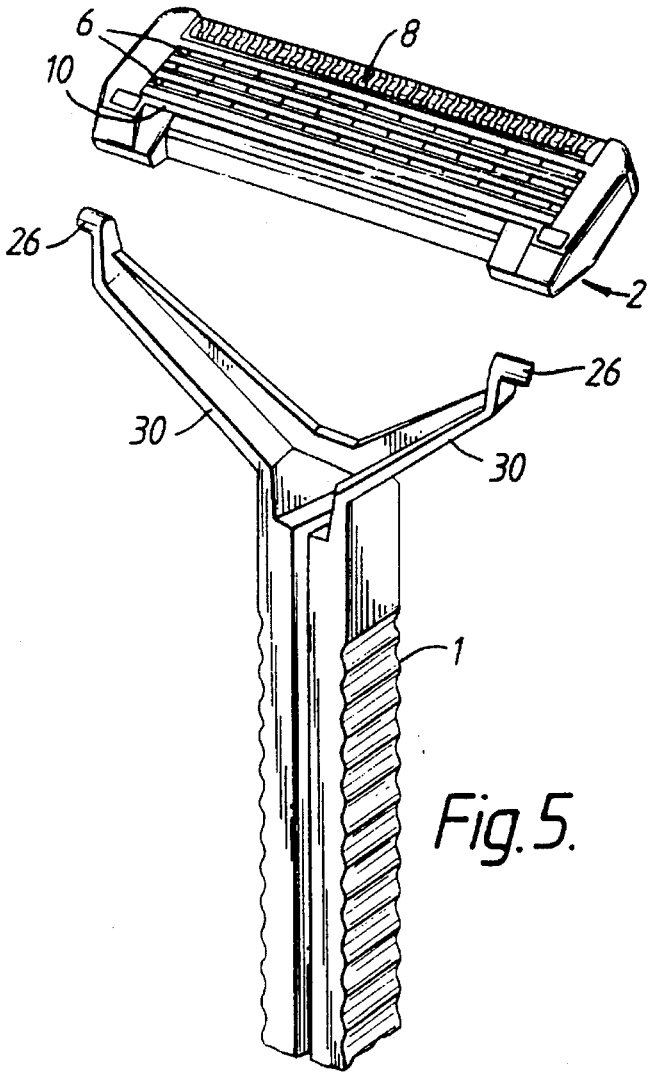
FIG. 5 is an exploded perspective view of an alternative embodiment.

The embodiment shown in FIG. 5 is essentially the same as described above except that the wing tips with the stub axles and cam abutment edges are formed at the ends of integral wings 30 provided by a one-piece bifurcated handle. In this case the wings are resilient and their elasticity is relied upon to press the wing tips against the cam faces 16 of the cartridge.

I claim:

1. A safety razor comprising a blade unit having a top skin engaging surface, a bottom surface spaced from and generally opposite to said top surface; and sidewalls connecting said top and bottom surfaces; and, a handle supporting the blade unit for pivotal movement from a rest position, the handle being connected to the blade unit by a pair of opposed connecting pieces engaging the blade unit through the bottom thereof, at least one of said connecting pieces being urged resiliently into abutment with a cam face on the blade unit whereby to oppose displacement of the blade unit from the rest position and to apply a restoring force for returning the blade unit to the rest position, said handle having a pair of wings with tips forming the connecting pieces and biased apart by the wings; and a socket extending into the bottom of said blade unit adjacent each of said sidewalls for receiving said connecting pieces, wherein the wings (20) are hinged to the handle and acted upon by spring means (24) to urge the tips apart.

2. A safety razor comprising a blade unit having a top skin engaging surface, a bottom surface spaced from and generally opposite to said top surface; and sidewalls connecting said top and bottom surfaces; and, a handle supporting the blade unit for pivotal movement from a rest position, the handle being connected to the blade unit by a pair of opposed connecting pieces engaging the blade unit through the bottom thereof, at least one of said connecting pieces being urged resiliently into abutment with a cam face on the blade unit whereby to oppose displacement of the blade unit from the rest position and to apply a restoring force for returning the blade unit to the rest position, said handle having a pair of wings with tips forming the connecting pieces and biased apart by the wings; and a socket extending into the bottom of said blade unit adjacent each of said sidewalls for receiving said connecting pieces, wherein the wings (30) are resilient and serve as spring means to urge the tips apart.

3. A razor according to claim 2 wherein the wings (30) are integral with the handle.

4. A safety razor comprising a blade unit having a top skin engaging surface, a bottom surface spaced from and generally opposite to said top surface; and sidewalls connecting said top and bottom surfaces; and, a handle supporting the blade unit for pivotal movement from a rest position, the handle being connected to the blade unit by a pair of opposed connecting pieces engaging the blade unit through the bottom thereof, at least one of said connecting pieces being urged resiliently into abutment with a cam face on the blade unit whereby to oppose displacement of the blade unit from the rest position and to apply a restoring force for returning the blade unit to the rest position, said handle having a pair of wings with tips forming the connecting pieces and biased apart by the wings; and a socket extending into the bottom of said blade unit adjacent each of said sidewalls for receiving said connecting pieces, wherein the blade unit (2) is detachable from the handle by squeezing the wings together to disengage the wings together to disengage the wing tips (26) from the blade unit.

5. A safety razor comprising a blade unit having a top skin engaging surface, a bottom surface spaced from and generally opposite to said top surface; and sidewalls connecting said top and bottom surfaces; and, a handle supporting the blade unit for pivotal movement from a rest position, the handle being connected to the blade unit by a pair of opposed connecting pieces engaging the blade unit through the bottom thereof, at least one of said connecting pieces being urged resiliently into abutment with a cam face on the blade unit whereby to oppose displacement of the blade unit from the rest position and to apply a restoring force for returning the blade unit to the rest position, said handle having a pair of wings with tips forming the connecting pieces and biased apart by the wings; and a socket extending into the bottom of said blade unit adjacent each of said sidewalls for receiving said connecting pieces, wherein a cam face is disposed within each socket.

6. The razor of claim 5 wherein said socket has a first wall defining a stop surface and wherein said cam face is disposed within said socket at an angle to said stop surface.

* * * * *